US008396389B2

(12) United States Patent
Takazawa

(10) Patent No.: US 8,396,389 B2
(45) Date of Patent: Mar. 12, 2013

(54) IMAGE FORMING APPARATUS HAVING ENDLESS BELT HAVING ABUTTING SURFACE HAVING SPECIFIC MIRROR SURFACE SMOOTHNESS AND PENSILE HARDNESS

(75) Inventor: Takayuki Takazawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 292 days.

(21) Appl. No.: 12/789,563

(22) Filed: May 28, 2010

(65) Prior Publication Data

US 2010/0303498 A1 Dec. 2, 2010

(30) Foreign Application Priority Data

Jun. 1, 2009 (JP) ..... 2009-132021

(51) Int. Cl.

| | |
|---|---|
| ***G03G 15/16*** | (2006.01) |
| ***G03G 15/01*** | (2006.01) |
| ***G03G 21/00*** | (2006.01) |

(52) U.S. Cl. ..... 399/101; 399/302; 399/303; 399/350

(58) Field of Classification Search ..... 399/101, 399/302, 303, 350

See application file for complete search history.

(56) References Cited

U.S. PATENT DOCUMENTS

| | | | | |
|---|---|---|---|---|
| 6,094,556 | A * | 7/2000 | Tanaka et al. | 399/302 |
| 2009/0074492 | A1 * | 3/2009 | Ito | 399/388 |

FOREIGN PATENT DOCUMENTS

| | | | |
|---|---|---|---|
| JP | 11-024428 | A | 1/1999 |
| JP | 2003-005430 | A | 1/2003 |
| JP | 2007-171273 | A | 7/2007 |
| JP | 2007-206401 | A | 8/2007 |
| JP | 2007-225969 | | 9/2007 |
| JP | 2007-225969 | A | 9/2007 |
| JP | 2008-310199 | A | 12/2008 |

* cited by examiner

*Primary Examiner* — Joseph S Wong

(74) *Attorney, Agent, or Firm* — Kubotera & Associates, LLC

(57) ABSTRACT

An image forming apparatus includes a belt including an abutting surface and a cleaning member disposed to abut against the abutting surface for removing a foreign substance on the abutting surface. The abutting surface has a mirror surface smoothness of 40 to 200, and a pensile hardness of 2H to 7H.

9 Claims, 5 Drawing Sheets

IMAGE FORMING APPARATUS HAVING ENDLESS BELT HAVING ABUTTING SURFACE HAVING SPECIFIC MIRROR SURFACE SMOOTHNESS AND PENSILE HARDNESS

BACKGROUND OF THE INVENTION AND RELATED ART STATEMENT

The present invention relates to an image forming apparatus. More specifically, the present invention relates to an image forming apparatus having an endless belt.

In a conventional image forming apparatus, a cleaning blade formed of a urethane rubber and the like is provided to abut against an endless belt for cleaning toner remaining on the endless belt. The endless belt has a specific surface roughness and a specific mirror surface smoothness. (Refer to Patent Reference)

Patent Reference: Japanese Patent Publication No. 2007-225969

In the conventional image forming apparatus described above, the endless belt includes a main layer formed of an elastic resin. Accordingly, a surface of the endless belt wears with time in use, and the mirror surface smoothness thereof tends to deteriorate, thereby lowering a cleaning performance of the cleaning blade. Accordingly, it is difficult to maintain reliability of the cleaning performance for a long period of time.

In view of the problems described above, an object of the present invention is to provide an image forming apparatus capable of solving the problems of the conventional image forming apparatus. In the present invention, it is possible to maintain reliability of a cleaning performance of a cleaning blade for a long period of time.

Further objects and advantages of the invention will be apparent from the following description of the invention.

SUMMARY OF THE INVENTION

In order to attain the objects described above, according to an aspect of the present invention, an image forming apparatus includes an endless belt including an abutting surface and a cleaning member disposed to abut against the abutting surface for removing a foreign substance on the abutting surface. The abutting surface has a mirror surface smoothness of 40 to 200, and a pensile hardness of 2H to 7H.

In the present invention, it is possible to maintain reliability of a cleaning performance of the endless belt for a long period of time.

DETAILED DESCRIPTION OF PREFERRED EMBODIMENTS

Hereunder, embodiments of the present invention will be explained with reference to the accompanying drawings.

First Embodiment

Figure 1:
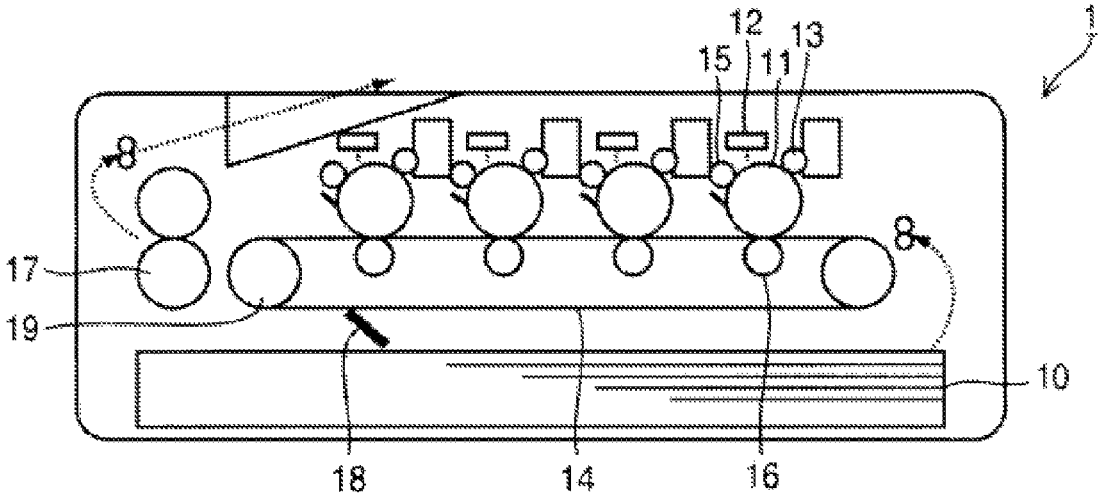
FIG. 1 is a schematic sectional side view showing an image forming apparatus according to a first embodiment of the present invention.

A first embodiment of the present invention will be explained. FIG. 1 is a schematic sectional side view showing an image forming apparatus 1 according to the first embodiment of the present invention.

As shown in FIG. 1, the image forming apparatus 1 includes photosensitive drums 11 as image supporting members; charging rollers 15 for charging surfaces of the photosensitive drums 11; LED (Light Emitting Diode) heads 12 for forming static latent images on the photosensitive drums 11; developing units 13 for supplying toner to the static latent images on the photosensitive drums 11 to develop the static latent images; transfer rollers 16 for transferring developed toner images from the photosensitive drums 11 to a recording member as a recording medium; an endless belt 14 for supporting the recording member; a fixing unit 17 for fixing the toner images transferred to the recording member; a cleaning blade 18 as a cleaning member for removing toner on the endless belt 14; and a sheet supply unit 10 for supplying the recording member retained therein.

Figure 2:
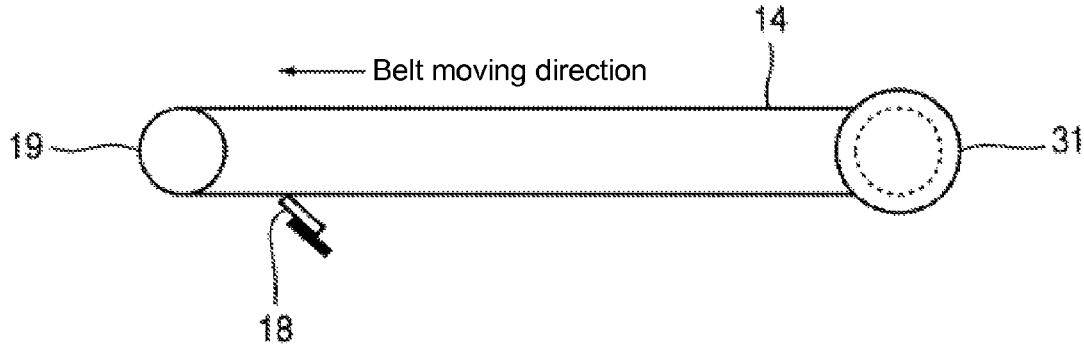
FIG. 2 is a schematic side view showing an endless belt drive device of the image forming apparatus according to the first embodiment of the present invention.

An endless belt drive device of the image forming apparatus 1 will be explained next. FIG. 2 is a schematic side view showing the endless belt drive device of the image forming apparatus 1 according to the first embodiment of the present invention.

As shown in FIG. 2, the endless belt 14 as an endless belt member is extended with an extension member (not shown) at an extension force of 6±10% kg. A drive roller 19 is provided for rotating the endless belt 14. A flange 31 as a guide member with a flange shape is provided for preventing the endless belt 14 from rotating in a wobble way. The flange 31 is arranged to rotate while following the endless belt 14, and abuts against side portions of the endless belt 14.

In the embodiment, the flange 31 may be attached to a rotation member if necessary, or may be disposed at both sides of the endless belt 14. Further, the flange 31 may be attached to a belt supporting member (not shown). The cleaning blade 18 is arranged to abut against the endless belt 14 for removing toner remaining on the endless belt 14.

Figure 5:
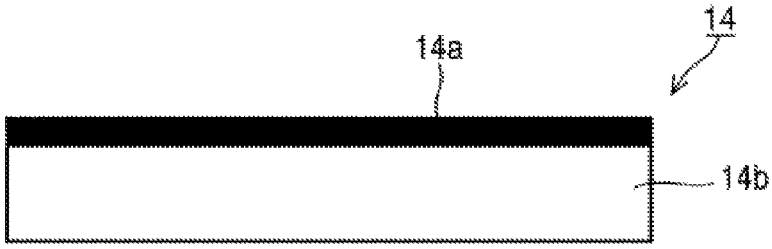
FIG. 5 is a schematic sectional view showing an endless belt of the image forming apparatus according to the first embodiment of the present invention.

A configuration of the endless belt 14 will be explained next with reference to FIG. 5. FIG. 5 is a schematic sectional view showing the endless belt 14 of the image forming apparatus 1 according to the first embodiment of the present invention.

As shown in FIG. 5, the endless belt 14 is formed of two layers including a surface layer 14*a* forming a toner image supporting surface and abutting against the cleaning blade 18, and a base layer 14*b* covered with the surface layer 14*a*. Further, the endless belt 14 has an abutting surface 14*c*.

In the embodiment, the surface layer 14*a* of the endless belt 14 preferably has a film thickness of 1 μm to 10 μm. Accordingly, the surface layer 14*a* is sufficiently thin, so that the surface layer 14*a* can follow an elastic deformation of the base layer 14*b*. Further, the film thickness of the surface layer 14*a* is adjusted such that the surface layer 14*a* has a specific mirror surface smoothness. The base layer 14*b* has a thickness of 140 μm in view of durability against damage of an end portion of the endless belt 14.

A method of producing the endless belt 14 will be explained next. In the first step, the base layer 14*b* is produced with one resin layer or a plurality of resin layers. In the next step, the surface layer 14*a* is formed on the base layer 14*b*.

More specifically, a resin is continuously extruded from a die metal with a cylindrical shape section to form the base layer 14*b*, so that the base layer 14*b* has a film thickness of 140 μm and a circumferential length of 624±1.5 mm. Accordingly, the base layer 14*b* is produced such that several endless belts each to become the endless belt 14 are connected together in a width direction thereof. The production method of the base layer 14*b* is not limited to the extrusion molding method, and may be an inflation molding method, an injection molding method, a dip molding method and the likes.

In the next step, the base layer 14*b* thus prepared is set in an outer surface of a die metal with a specific dimension, and the surface layer 14*a* is formed through a spray coating, a roller coating, or a dip coating. At this moment, the film thickness of the surface layer 14*a* is adjusted according to a concentration and a coating amount of a material to be coated.

After the surface layer 14*a* is formed on the base layer 14*b*, the surface layer 14*a* is cured through a thermal process or UV (Ultra Violet) radiation. Afterward, the endless belt 14 with the surface layer 14*a* thus formed is removed from the die metal, and cut in a width of 228.0±0.5 mm.

In the embodiment, the surface layer 14*a* may be formed of a material such as polyacryl, polyacrylurethane, polyesterurethane, polyetherurethane, polyamide (PA), polyacrylonitrile-butadiene-styrene (ABS), polycarbonate (PC), polybutylene-terephthalate (PBT), polyetylene-terephthalate (PET), a styrene compound, a naphthalene compound, and the like. In the embodiment, the surface layer 14*a* is formed of polyacryl.

In the embodiment, the base layer 14*b* is formed of a resin not limited to any specific types. It is preferred that the base layer 14*b* is formed of a material exhibiting a tensional deformation within a specific range when the endless belt 14 is driven in view of durability and a mechanical characteristic. Further, it is preferred that the base layer 14*b* is formed of a material exhibiting resistance at an side portion thereof against wear, bending, cracking and the like due to repetitive sliding against a wobble prevention member.

In the embodiment, the base layer 14*b* may be formed of a material such as polyamide (PA), polyvinylidene-fluoride (PvDF), polybutylene-terephthalate (PBT), polycarbonate (PC), polyacrylonitrile-butadiene-styrene (ABS), polyacrylonitrile-ethylenepropylene-styrene, polyacetal, polyacrylonitrile, poly-vinylindene-fluoride, poly-hexafluoroethylenepropylene, poly-trifluoroethylene, polyamidimide, polyimide, and the like. In the embodiment, the base layer 14*b* is formed of polyamide (PA).

In the embodiment, the base layer 14*b*, or the base layer 14*b* and the surface layer 14*a* may contain carbon black at a specific amount to impart conductivity therein.

In the embodiment, carbon black includes furnace black, channel black, ketjen black, acetylene black, and the likes. Carbon black may be just one of the materials listed above, or a mixture thereof. A type of carbon black is selected according to a target level of conductivity. In the embodiment, it is preferred to use furnace black or channel black. Further, it is preferred that an oxidation process or a graft process is performed on carbon black to suppress oxidation deterioration or improve dispersion ability in a solvent.

In the embodiment, an amount of carbon black is determined according to the type of carbon black selected depending on a purpose. In the image forming apparatus 1 in the embodiment, the endless belt 14 contains 3 to 40 weight % of carbon black relative to the belt composition resin in view of required mechanical strength and the like.

In the embodiment, it is possible to adjust the mirror surface smoothness of the surface layer 14*a* through adjusting the coating amount to control the film thickness of the surface layer 14*a*. More specifically, when the film thickness of the surface layer 14*a* is small, a surface roughness of the surface layer 14*a* becomes significant, thereby reducing the mirror surface smoothness of the surface layer 14*a*. On the other hand, when the film thickness of the surface layer 14*a* is large, a surface roughness of the surface layer 14*a* becomes less significant, thereby increasing the mirror surface smoothness of the surface layer 14*a*.

In the embodiment, other than adding carbon black, it is possible to impart conductivity to the endless belt 14 through adding an ion conductive agent in the base layer 14*b* or the surface layer 14*a*, or both. The ion conductive agent may include lithium perchlorate, sodium perchlorate, an alkaline metal salt such as trifluoromethane-sulfonicacid-lithium, trifluoromethane-boronicacid-lithium, thiopotassium-cyanate, and thiopotassium-lithium, an alkaline-earth metal salt, and a quaternary ammonium salt.

In the embodiment, toner is produced through an emulsion polymerization method, and is formed of a styrene-acryl copolymer as a main component. Further, toner contains paraffin wax in an amount of 9 weight %, and has an average particle size of 7 μm and a sphericity of 0.95. Accordingly, it is possible to improve transfer efficiency, eliminate a separation agent in a fixing process, and obtain an image with high sharpness and quality due to excellent dot reproducibility and resolution.

In the embodiment, the cleaning blade 18 is formed of a urethane rubber having a JIS A rubber hardness of 72° and a thickness of 1.5 mm. The cleaning blade 18 is arranged to contact with the endless belt 14 with a line pressure of 4.3 g/mm. When the cleaning blade 18 is formed of the urethane rubber, it is possible to effectively remove remaining toner or a foreign substance, and to reduce a cost due to a simple configuration thereof. The urethane rubber exhibits a high hardness as well as sufficient flexibility, and further provides high wear resistance, mechanical strength, oil resistance, and ozone resistance.

More specifically, it is preferred that the cleaning blade 18 is formed of the urethane rubber having the JIS A rubber hardness of 60° to 90°, more preferably 70° to 85°. Further, it is preferred that the urethane rubber has a breaking elongation of 250 to 500%, more preferably 300 to 400%; a permanent elongation of 1.0 to 2.0%; and a resilient modulus of 10 to 70%, more preferably 30 to 50%. The properties are measured according to JIS K6301.

In the embodiment, it is preferred that the cleaning blade 18 is arranged to contact with the endless belt 14 with the line pressure of 1 to 6 g/mm, more preferably 2 to 5 g/mm. When the cleaning blade 18 contacts with the endless belt 14 with a small line pressure, the cleaning blade 18 does not sufficiently contact with the endless belt 14, thereby making it difficult to clean the endless belt 14. On the other hand, when the cleaning blade 18 contacts with the endless belt 14 with an excessive line pressure, the cleaning blade 18 contacts with the endless belt 14 over an excessive area, thereby increasing frictional resistance or causing deformation and abnormal noises.

In the embodiment, the drive roller 19 has an axial diameter of 25 mm. The axial diameter is not limited to 25 mm, and may be 10 to 50 mm generally according to a cost and a size of the image forming apparatus 1.

In the embodiment, a spring is provided for extending the endless belt 14 with the extension force of 6±10% kg. A method of extending the endless belt 14 is not limited to the spring. Further, the extension force for extending the endless belt 14 is adjusted according to the material of the endless belt 14 and the belt drive device, and is generally in a range of 2 to 8±10% kg.

Figure 6:
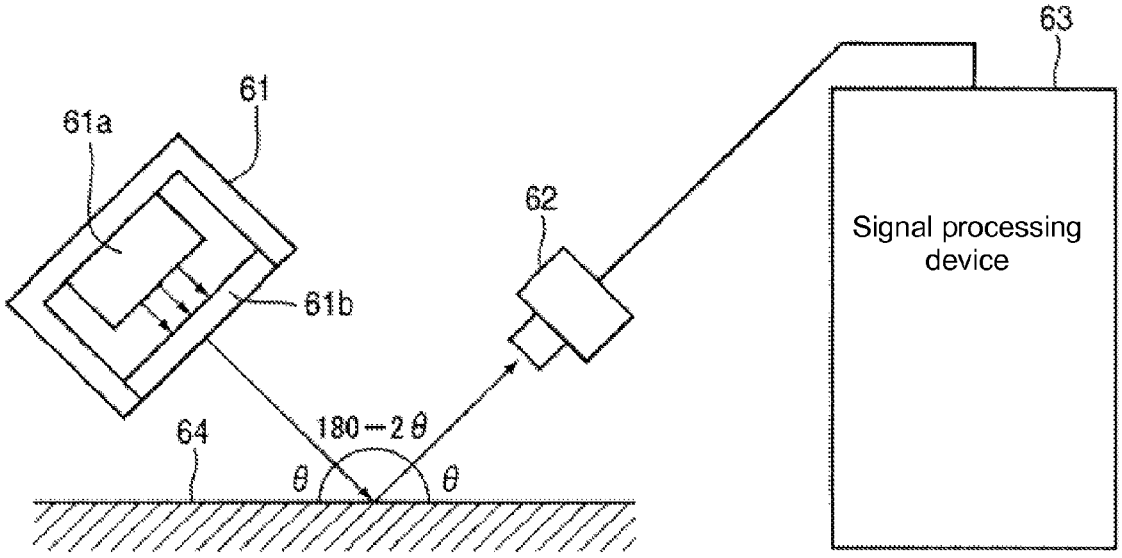
FIG. 6 is a schematic view showing a measurement device for measuring a mirror surface smoothness of the endless belt of the image forming apparatus according to the first embodiment of the present invention.

A method of measuring the mirror surface smoothness will be explained next. A measurement device such as SPOT AHS-100S (a product of ARCHARIMA Co., Ltd.) shown in FIG. 6 is used for measuring the mirror surface smoothness. FIG. 6 is a schematic view showing the measurement device for measuring the mirror surface smoothness of the endless belt 14 of the image forming apparatus 1 according to the first embodiment of the present invention.

As shown in FIG. 6, the measurement device for measuring the mirror surface smoothness includes a pattern projection device 61, an optical-electric conversion element 62, and a signal processing device 63.

Figure 7:
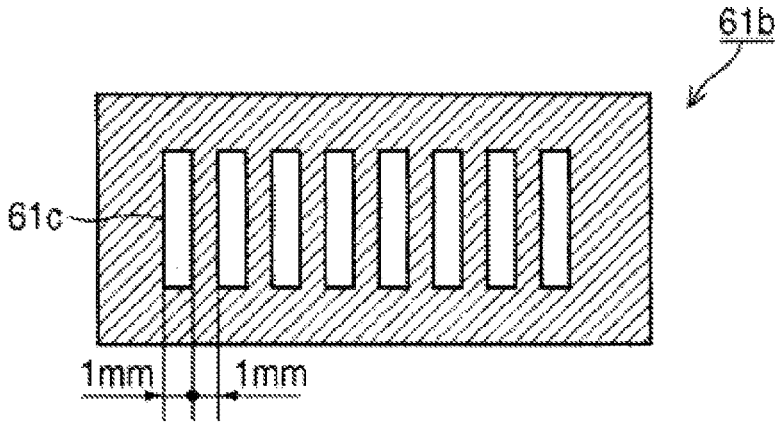
FIG. 7 is a schematic view showing a pattern projection plate of the measurement device for measuring the mirror surface smoothness of the endless belt of the image forming apparatus according to the first embodiment of the present invention.

In the measurement device, the pattern projection device 61 includes a light source 61*a* and a pattern projection plate 61*b*. FIG. 7 is a schematic view showing the pattern projection plate 61*b* of the measurement device for measuring the mirror surface smoothness of the endless belt 14 of the image forming apparatus 1 according to the first embodiment of the present invention.

As shown in FIG. 7, the pattern projection plate 61*b* is formed of a stainless steel plate with a thickness of 0.5 mm. The pattern projection plate 61*b* has a plurality of opening portions 61*c* with a width of 1 mm arranged in parallel in rows. A surface of the pattern projection plate 61*b* is coated with a matte paint. The opening portions 61*c* are arranged next to with each other with an interval of 1 mm.

As shown in FIG. 6, the pattern projection device 61 is arranged such that the pattern projection device 61 irradiates light on the abutting surface 14*c* of the endless belt 14 as an object surface 64 at an angle θ. The optical-electric conversion element 62 is arranged such that an optical axis of the optical-electric conversion element 62 is aligned with an optical axis of the pattern projection device 61 on a same plane at an angle of (180−2θ) degrees.

The optical-electric conversion element 62 is formed of a CCD (Charge Coupled Device) array in which a plurality of light receiving portions is arranged linearly (one dimensionally) or two dimensionally. Further, the optical-electric conversion element 62 outputs a reflection intensity signal to the signal processing device 63.

In the measurement device, the signal processing device 63 converts the reflection intensity signal sent from the optical-electric conversion element 62 to a digital signal (A/D conversion). Further, the signal processing device 63 processes a wave shape of the digital signal thus converted, so that the signal processing device 63 determines a maximum value (Max) and a minimum value (Min) of the reflection intensity signal. Accordingly, the signal processing device 63 calculates and displays the mirror surface smoothness from the maximum value (Max) and the minimum value (Min) of the reflection intensity signal.

An operation of the image forming apparatus 1 will be explained next. First, when the image forming apparatus 1 receives print data instructing a printing operation from a host device, the sheet supply unit 10 supplies the recording member, so that the endless belt 14 transports the recording member to the photosensitive drums 11. In the image forming apparatus 1, the charging rollers 15 charge the surfaces of the photosensitive drums 11, so that the static latent images are formed on the surfaces of the photosensitive drums 11. The developing units 13 supply toner to develop the static latent images, so that the static latent images are visualized as the toner images.

In the next step, after the toner images are formed on the photosensitive drums 11 as the visualized images, the transfer rollers 16 transfer the toner images to the recording member transported with the endless belt 14 while supporting the recording member. After the toner images are transferred to the recording member, the recording member is transported to the fixing unit 17, so that the toner images are fixed and the recording member is discharged. After the recording member is discharged, the cleaning blade 18 removes toner or a foreign substance remaining on the endless belt 14, thereby cleaning the endless belt 14.

An operation of the measurement device for measuring the mirror surface smoothness will be explained next with reference to FIG. 6.

First, the light source 61*a* irradiates parallel light on the pattern projection plate 61*b*, so that a light-dark pattern is projected on the object surface 64. Then, the optical-electric conversion element 62 captures the light-dark pattern projected on the object surface 64, so that the optical-electric conversion element 62 converts a captured image to an electrical signal.

In the next step, the optical-electric conversion element 62 outputs the electrical signal thus converted as an output signal (the reflection intensity signal) to the signal processing device 63. The signal processing device 63 converts the reflection intensity signal to the digital signal (A/D conversion), thereby obtaining a result shown in FIG. 8.

Figure 8:
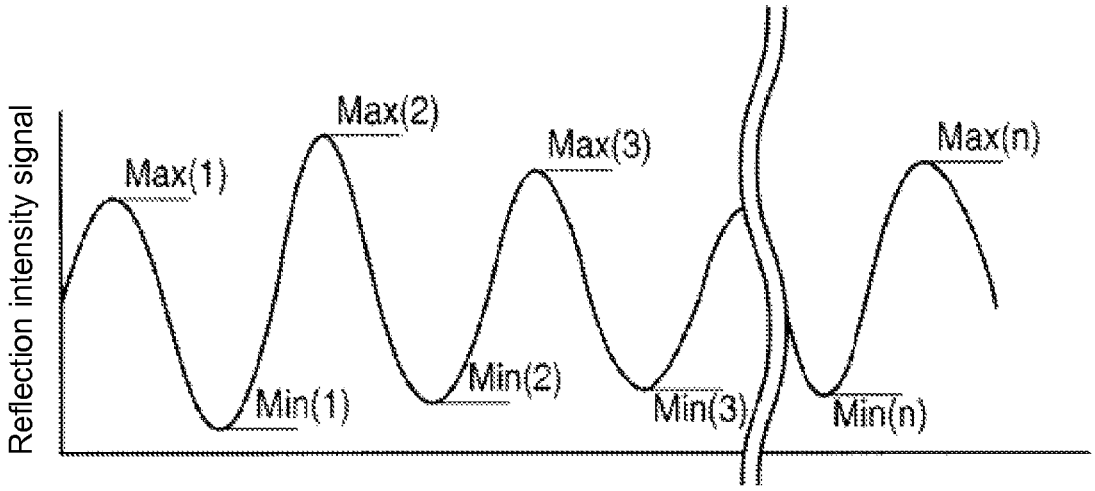
FIG. 8 is a graph showing an example of a result of the measurement device for measuring the mirror surface smoothness of the endless belt of the image forming apparatus according to the first embodiment of the present invention.

FIG. 8 is a graph showing an example of the result of the measurement device for measuring the mirror surface smoothness. Accordingly, the signal processing device 63 determines the maximum value (Max) and the minimum value (Min) of the reflection intensity signal.

In the example shown in FIG. 8, an average of the maximum values Max(Ave.) is obtained through the following equation (1).

$$\text{Max(Ave.)}=\Sigma\text{Max}(n)/n(n=1, 2, 3 \ldots) \quad (1)$$

In the example shown in FIG. 8, an average of the minimum values Min(Ave.) is obtained through the following equation (2).

$$\text{Min(Ave.)}=\Sigma\text{Min}(n)/n(n=1, 2, 3 \ldots) \quad (2)$$

Further, from the average of the maximum values Max (Ave.) and the average of the minimum values Min(Ave.), a parameter P of the object surface 64 is calculated through the following equation (3).

$$P=\{\mathrm{Max(Ave.)}-\mathrm{Min(Ave.)}\}/\{\mathrm{Max(Ave.)}+\mathrm{Min(Ave.)}\} \quad (3)$$

When the object surface 64 has an ideal surface, the parameter P has a value of one. Accordingly, the mirror surface smoothness is obtained through the following equation (4) with the object surface 64 having the ideal surface as a standard. Note that the mirror surface smoothness represents a quantified value of an imaging capability of a surface profile.

$$\text{Mirror surface smoothness}=(\text{value of the parameter of the object surface})/(\text{value of the parameter of the ideal surface})\times 1000 \quad (4)$$

Conventionally, a fine profile of a surface is quantified through measuring a surface roughness, a degree of surface gloss, and the like. However, the conventional method represents only part of surface characteristics, and the imaging capability of the surface profile is generally evaluated through visual inspection.

As described above, the measurement device shown in FIG. 6 is capable of quantifying the mirror surface smoothness through measuring brightness of the light-dark pattern (a reflection image) projected on the object surface 64 and calculated as a relative value between the object surface 64 and the ideal surface based on the variance in the distribution of the reflection intensity signal (brightness). When the object surface 64 has a large value of the mirror surface smoothness relative to 1,000 of the ideal surface, the object surface 64 has a good surface profile.

An experiment was conducted for evaluating cleaning performance of the cleaning blade 18. In the experiment, the endless belt 14 moved at a line speed of about 144 mm/second, and the recording member was an A4 size sheet. Further, in the experiment, the image forming apparatus 1 printed a print pattern formed of lateral lines in four colors (cyan, magenta, yellow, and black) at a density of 0.5% per the recording member, and performed the printing operation on three recording members with an interval of 7 seconds (3 Paper/Job) under an environment at a temperature of 10° C. and a humidity of 20%.

In the experiment, the hardness of the endless belt 14 was determined according to whether an aggregated damage occurred in the surface layer 14*a* according to pensile hardness JIS K-5600-5-4.

In the experiment, after the endless belt 14 passed through the cleaning blade 18, the cleaning performance was evaluated whether toner remaining on the endless belt 14 was removed. When toner remaining on the endless belt 14 was completely removed, a cleaning problem did not occur. When toner on the endless belt 14 was not completely removed and still remained on toner, the cleaning problem did occur.

Table 1 shows results of the evaluation. In Table 1, when the cleaning problem did not occur after the image forming apparatus 1 printed more than 80,000 sheets, the cleaning performance was represented as good. When the cleaning problem did occur after the image forming apparatus 1 printed between 30,000 to 60,000 sheets, the cleaning performance was represented as fair. When the cleaning problem did occur after the image forming apparatus 1 printed less than 30,000 sheets, the cleaning performance was represented as poor.

TABLE 1

| Mirror surface smoothness | Pensile hardness | Cleaning performance |
|---|---|---|
| 35 | B | poor |
| 48 | B | poor |
| 75 | B | fair |
| 100 | B | fair |
| 30 | HB | poor |
| 53 | HB | poor |
| 76 | HB | fair |
| 105 | HB | fair |
| 30 | H | poor |
| 52 | H | fair |
| 75 | H | good |
| 98 | H | good |
| 202 | H | good |
| 28 | 2H | fair |
| 40 | 2H | good |
| 78 | 2H | good |
| 103 | 2H | good |
| 148 | 2H | good |
| 200 | 2H | good |
| 27 | 3H | fair |
| 40 | 3H | good |
| 105 | 3H | good |
| 45 | 5H | good |
| 80 | 5H | good |
| 180 | 5H | good |
| 42 | 7H | good |
| 86 | 7H | good |
| 190 | 7H | good |

Figure 9:
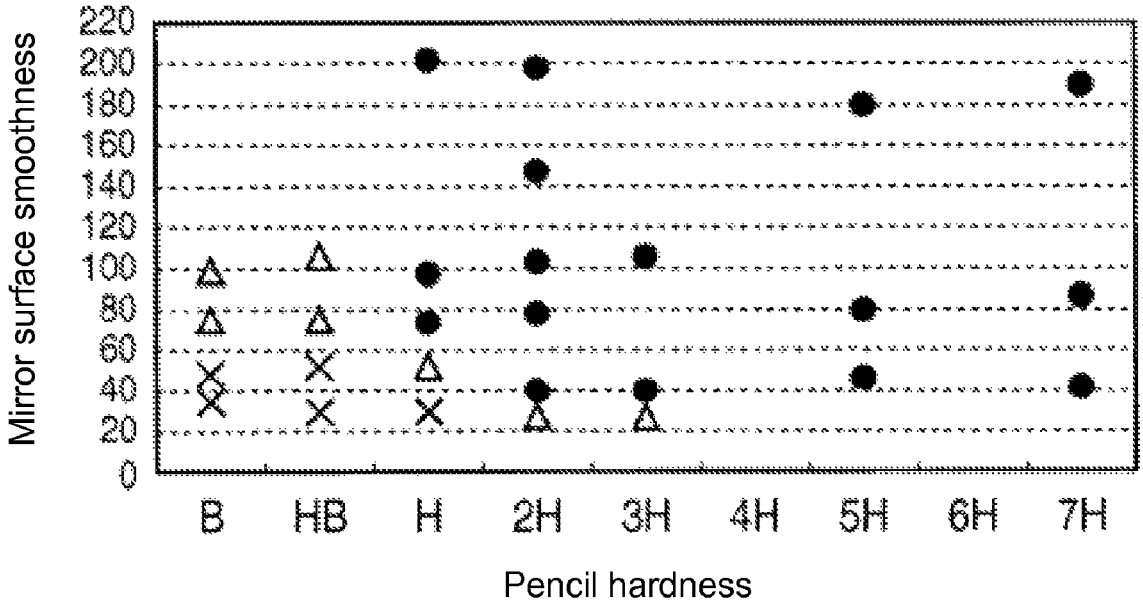
FIG. 9 is a graph showing results of a cleaning performance evaluation of the image forming apparatus according to the first embodiment of the present invention.

FIG. 9 is a graph showing the results of the cleaning performance evaluation of the image forming apparatus 1 according to the first embodiment of the present invention. In FIG. 9, when the cleaning problem did not occur after the image forming apparatus 1 printed more than 80,000 sheets, the cleaning performance was represented as a closed circle. When the cleaning problem did occur after the image forming apparatus 1 printed between 30,000 to 60,000 sheets, the cleaning performance was represented as an empty rectangular. When the cleaning problem did occur after the image forming apparatus 1 printed less than 30,000 sheets, the cleaning performance was represented as a cross mark.

As shown in Table 1 and FIG. 9, when the endless belt 14 has the mirror surface smoothness between 40 and 200 and the pensile hardness between 2H and 7H, it is possible to obtain the good cleaning performance. Further, when the endless belt 14 has the mirror surface smoothness between 60 and 200 and the pensile hardness greater than H, it is possible to obtain the good cleaning performance.

In general, when a surface of a belt has a large undulation, a foreign substance tends to adhere to the surface more easily, and tends to remain on the surface even after a cleaning blade scrapes off the foreign substance to clean the surface of the belt.

In a general image forming apparatus, when a printing operation continues, a foreign substance generated from toner or a recording member (paper) tends to attach to a surface of a belt. Once one foreign substance attaches to the surface of the belt, a similar foreign substance tends to adhere to the surface more easily due to an increased intermolecular force or compatibility, thereby accumulating the foreign substances on the belt.

The foreign substance generated from toner or a recording member (paper) may include silica and calcium carbonate. It is known that silica and calcium carbonate have high hardness. When silica and calcium carbonate contact with the belt, the belt tends to wear and be damaged more easily, thereby causing a scratch thereon.

When the endless belt 14 has the mirror surface smoothness less than 40 and the pensile hardness less than 2H, the belt tends to wear and be damaged more easily. More specifically, the endless belt 14 has the mirror surface smoothness less than 40, it is difficult to contact the cleaning blade 18 against the endless belt 14 with a constant line pressure. Accordingly, toner attached to the surface of the endless belt 14 tends to pass through the cleaning blade 18. When toner has a higher sphericity, toner attached to the surface of the endless belt 14 tends to pass through the cleaning blade 18 more easily.

When toner has a smaller particle size, it is possible to easily obtain high image quality. In this case, a relative surface area increases. Accordingly, toner tends to adhere to the endless belt 14 with a larger attraction force per unit amount thereof, thereby deteriorating the cleaning performance of the cleaning blade 18.

Further, when toner has a smaller particle size, flow ability of toner is deteriorated, so that it is necessary to increase an amount of an additive such as silica and wax.

In this case, when the endless belt 14 has a smaller mirror surface smoothness, the additive tends to remain on the surface of the endless belt 14 and pass through the cleaning blade 18 more easily. When the additive passes through the cleaning blade 18, a local shear stress is applied to the cleaning blade 18, thereby causing a local edge damage (chipping) or even leading damage of the cleaning blade 18.

Further, the surface of the endless belt 14 has a higher hardness and a smaller mirror surface smoothness, an edge of the cleaning blade 18 is polished with the surface of the endless belt 14. Accordingly, the cleaning blade 18 tends to wear more easily, thereby making toner or the additive to pass through the cleaning blade 18 more easily.

On the other hand, when the endless belt 14 has a higher mirror surface smoothness, it is possible to prevent toner or the additive from passing through the cleaning blade 18. However, a frictional force between the endless belt 14 and the cleaning blade 18 increases, thereby causing deformation of the cleaning blade 18 and abnormal noises. Accordingly, it is preferred that the endless belt 14 has the mirror surface smoothness less than 200.

When the endless belt 14 has the pensile hardness less than 2H, a scratch tends to occur in the surface of the endless belt 14 more easily. More specifically, when the endless belt 14 has a smaller pensile hardness, silica and calcium carbonate with high hardness tend to cause a scratch in the surface of the endless belt 14 each time the printing operation is performed. Further, when the endless belt 14 has a smaller pensile hardness, a scratch tends to extend more easily. Accordingly, it is difficult to contact the cleaning blade 18 with the endless belt 14 closely, thereby causing the cleaning problem.

In other words, it is not suffice that the endless belt 14 has only a higher mirror surface smoothness. In this case, the cleaning performance is good at an initial stage. However, each time the printing operation is performed, a scratch tends to occur in the surface of the endless belt 14. Accordingly, the mirror surface smoothness is deteriorated and the cleaning performance is lowered.

Accordingly, it is preferred that the endless belt 14 has the pensile hardness smaller than 7H. When the endless belt 14 has the pensile hardness greater than 9H (corresponding to a hardness of ceramic), the endless belt 14 may cause damage in the photosensitive drum 11 against which the endless belt 14 abuts. Further, it is difficult to form a coating with the pensile hardness greater than 8H or 9H on the endless belt 14 with a polymeric material, or it take a large cost to form such a coating.

Further, when the endless belt 14 has the pensile hardness to an excessive extent, a hardness difference between the surface layer 14*a* and the base layer 14*b* becomes large. Accordingly, it is difficult for the surface layer 14*a* to follow a deformation of the base layer 14*b*. As a result, a crack tends to occur in the surface of the endless belt 14 with time.

When the endless belt 14 has the mirror surface smoothness less than 40 and the pensile hardness less than 2H, the surface of the endless belt 14 tends to be undulated. Accordingly, a micro slipping tends to occur between the endless belt 14 and a printing surface of the recording member. As a result, wax or an outer additive situated near the printing surface tends to be scraped off more easily, and adhere to the surface of the endless belt 14 more easily. When wax or an outer additive is attached to the surface of the endless belt 14, wax or the outer additive tends to be accumulated at an edge portion of the cleaning blade 18 and pass through the cleaning blade 18, thereby causing the cleaning problem.

Further, when a large amount of foreign substances is accumulated on the endless belt 14, the frictional force between the endless belt 14 and the cleaning blade 18 tends to increase due to close contact or compatibility between the foreign substances on the endless belt 14 and the cleaning blade 18. When the frictional force increases, a shear stress is generated between the surface of the endless belt 14 and the cleaning blade 18, thereby causing a local edge damage (chipping) and deformation of the cleaning blade 18 or even leading fatal damage of the cleaning blade 18.

In order to prevent the cleaning problem, it may be configured such that the cleaning blade 18 abuts against the endless belt 14 with a large line pressure. In this case, however, a large load tends to be applied to the cleaning blade 18, thereby causing a local edge damage (chipping) or deformation of the cleaning blade 18. Further, when the cleaning blade 18 abuts against the endless belt 14 with a large line pressure, a scratch tends to occur in the surface of the endless belt 14 more easily. Accordingly, it is not preferred that the cleaning blade 18 abuts against the endless belt 14 with a large line pressure.

In the first embodiment, the image forming apparatus 1 shown in FIG. 1 is explained as the image forming apparatus. The present invention is not limited thereto, and is applicable to an image forming apparatus 2 of an intermediate transfer type as shown in FIG. 3.

Figure 3:
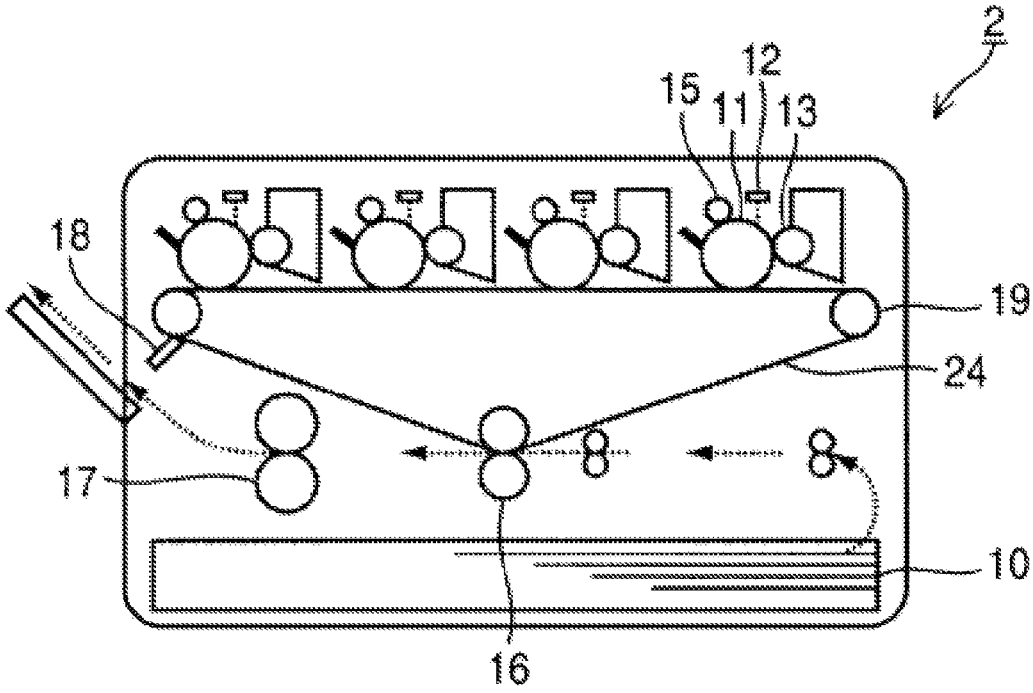
FIG. 3 is a schematic sectional side view showing an image forming apparatus of an intermediate transfer type according to the first embodiment of the present invention.
Figure 4:
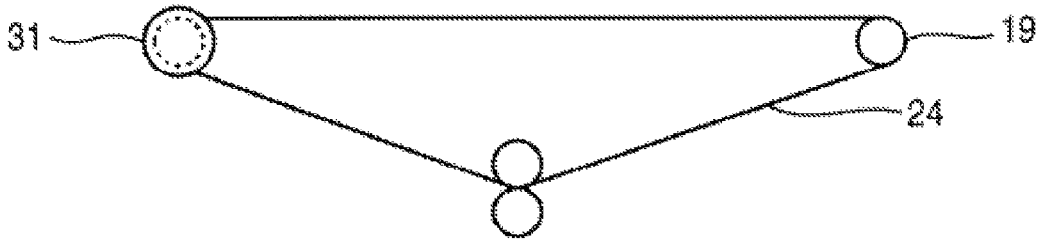
FIG. 4 is a schematic side view showing an endless belt drive device of the image forming apparatus of the intermediate transfer type according to the first embodiment of the present invention.

FIG. 3 is a schematic sectional side view showing the image forming apparatus 2 of the intermediate transfer type according to the first embodiment of the present invention. In the image forming apparatus 2, an intermediate transfer belt 24 is provided for directly supporting toner images visualized through a developing process.

As described above, in the first embodiment, the endless belt 14 has the mirror surface smoothness between 40 and 200 and the pensile hardness between 2H and 7H. Accordingly, it is possible to prevent the mirror surface smoothness from deteriorating due to wear of the surface of the endless belt 14 or a foreign substance such as paper powder attached to the surface of the endless belt 14, thereby maintaining the good cleaning performance for a long period of time.

Second Embodiment

A second embodiment of the present invention will be explained next. In the second embodiment, the base layer 14*b* of the endless belt 14 is produced to have a specific Young's modulus. Components in the second embodiment similar to those in the first embodiment are designated with the same reference numerals, and explanations thereof are omitted.

An experiment was conducted for evaluating the cleaning performance of the cleaning blade 18 using the endless belt 14 in which the surface layer 14*a* has the mirror surface roughness of 50. In the experiment, the Young's modulus of the base layer 14*b* of the endless belt 14 was measured according to JIS K7127. More specifically, after a test specimen was punched out from the base layer 14*b* using a punch mold type 2, a thickness of the test specimen was measured with a micrometer. Then, the test specimen was tested using a tension test machine Tensilon RTM-100 (a product of ORIENTEC Co., Ltd.) at a test speed of 50 mm/min.

In the experiment, the cleaning performance was evaluated with a method similar to that described in the first embodiment. Table 2 shows results of the evaluation.

In Table 2, the results of the cleaning performance are represented similar to those in Table 1. The surface of the endless belt 14 was observed with an actual image microscope to determine whether a crack was created in the surface layer 14*a*, so that durability of the endless belt 14 was evaluated. When it was determined that the crack was not created in the surface layer 14*a*, the result was represented as good. When it was determined that the crack was created in the surface layer 14*a*, the result was represented as poor. The missing portion was evaluated according to whether toner was detached.

TABLE 2

| Mirror surface smoothness | Young's modulus (Mpa) | Cleaning performance | Belt durability | Missing portion |
|---|---|---|---|---|
| 48 | 500 | good | poor | good |
| 50 | 1000 | good | good | good |
| 50 | 1300 | good | good | good |
| 53 | 1700 | good | good | good |
| 47 | 2000 | good | good | good |
| 50 | 3500 | good | good | good |
| 50 | 5000 | good | good | good |

As shown in Table 2, when the base layer 14*b* has the Young's modulus between 1,000 and 5000 MPa, more preferably between 1,000 and 2,000 Mpa, and the surface layer 14*a* has the mirror surface smoothness between 40 and 200 and the pensile hardness between 2H and 7H, it is possible to prevent the missing portion due to an elastic deformation of the endless belt 14 as a whole while maintaining the cleaning performance. When the missing portion occurs, toner in a text portion or a line image becomes missing. Further, due to the elastic deformation of the endless belt 14, it is possible to absorb a variance in a load when the endless belt 14 is driven, thereby preventing the endless belt 14 from moving wobbly.

When the missing portion occurs, a roll presses only a toner layer in the transfer process or the fixing process, so that toner tends to be agglomerated and a charge density increases. Accordingly, discharge is generated inside toner, and a polarity of toner is changed, thereby causing the missing portion. In general, when a belt with a high Young's modulus is used, the belt does not elastically deform relative to a pressing force, so that the missing portion tends to occur more easily.

When the base layer 14*b* has the Young's modulus less than 1,000 MPa, the endless belt 14 tends to excessively deform elastically upon being driven. Accordingly, the surface layer 14*a* does not efficiently follow the deformation of the base layer 14*b*, thereby causing a crack in the surface layer 14*a*. As a result, a foreign substance tends to pass through the cleaning blade 18 more easily, or the endless belt 14 is susceptible to damage.

On the other hand, when the base layer 14*b* has the Young's modulus greater than 5,000 MPa, the endless belt 14 does not extend to a large extent. Accordingly, the endless belt 14 does not closely contact with the drive roller 19, thereby causing a color shift due to slippage of the endless belt 14. In order to prevent the slippage of the endless belt 14, the endless belt 14 may be extended with a large tension. However, when the endless belt 14 is extended with a large tension, it is necessary to increase strengths of the extension members such as the drive roller 19 and the follower roller for extending the endless belt 14, or a frame for supporting the extension rollers, thereby increasing a size of the image forming apparatus 1.

Further, when the base layer 14*b* has the Young's modulus greater than 2,000 MPa, it is necessary to add fibers such as inorganic filler in a resin of the base layer 14*b* or modify the resin, thereby making it difficult to use an ordinary inexpensive resin. Further, it is necessary to produce the base layer 14*b* at a high temperature, thereby increasing a cost of the endless belt 14. Accordingly, it is preferred that the base layer 14*b* has the Young's modulus between 1,000 and 2,000 MPa.

As described above, when the base layer 14*b* has the Young's modulus between 1,000 and 5000 MPa, and the surface layer 14*a* has the mirror surface smoothness between 40 and 200 and the pensile hardness between 2H and 7H, it is possible to prevent the image problem such as the missing portion while maintaining the good cleaning performance. Further, it is possible to stably move the endless belt 14 for a long period of time without causing a fetal problem such as a fracture of the endless belt 14.

In the embodiments described above, the image forming apparatus 1 is explained as the printer of the electro-photography type. The present invention is not limited to the embodiments described above, and may be applicable to a facsimile, and the like. Further, the endless belt 14 is explained as the transfer belt. The present invention is not limited to the embodiments, and is applicable to an endless belt such as a photosensitive belt and a fixing belt.

The disclosure of Japanese Patent Application No. 2009-132021, filed on Jun. 1, 2009, is incorporated in the application.

While the invention has been explained with reference to the specific embodiments of the invention, the explanation is illustrative and the invention is limited only by the appended claims.

What is claimed is:

1. An image forming apparatus comprising:

a belt including an abutting surface, said abutting surface having a mirror surface smoothness of 40 to 200 and a pensile hardness of 2H to 7H, or having the mirror surface smoothness of 60 to 200 and the pensile hardness equal to or greater than H and less than 2H; and a cleaning blade disposed to abut against the abutting surface for removing a substance on the abutting surface, wherein said belt includes a surface layer having the abutting surface and a base layer covered with the surface layer and formed of at least one resin layer, said surface layer has a thickness between 1 μm and 10 μm, and said cleaning blade is formed of a urethane rubber having a rubber hardness of 60 to 90° , a breaking elongation of 250 to 500%, and a modulus of repulsion elasticity of 10 to 70%, said cleaning blade being arranged to contact with the belt with a line pressure of 1 to 6 g/mm.

2. An image forming apparatus comprising:

a belt including an abutting surface, said abutting surface having a mirror surface smoothness of 40 to 200 and a pensile hardness of 2H to 7H; and a cleaning blade disposed to abut against the abutting surface for removing a substance on the abutting surface, wherein said belt includes a surface layer having the abutting surface and a base layer covered with the surface layer and formed of at least one resin layer, said surface layer has a thickness between 1 μm and 10 μm, and said cleaning blade is formed of a urethane rubber having a rubber hardness of 60 to 90° , a breaking elongation of 250 to 500%, and a modulus of repulsion elasticity of 10 to 70%, said cleaning blade being arranged to contact with the belt with a line pressure of 1 to 6 g/mm.

3. The image forming apparatus according to claim 2, where said base layer has a Young's modulus between 1,000 MPa and 5,000 MPa.

4. The image forming apparatus according to claim 2, where said base layer is formed of a polyamide.

5. The image forming apparatus according to claim 2, where said surface layer is formed of a polyacryl.

6. The image forming apparatus according to claim 4, where said base layer contains carbon black.

7. The image forming apparatus according to claim 5, where said surface layer contains carbon black.

8. The image forming apparatus according to claim 6, where said base layer contains carbon black in an amount of 3% to 40%.

9. The image forming apparatus according to claim 7, where said surface layer contains carbon black in an amount of 3% to 40%.

* * * * *